US007661474B2

(12) United States Patent
Campbell et al.

(10) Patent No.: US 7,661,474 B2
(45) Date of Patent: Feb. 16, 2010

(54) CONNECTOR ASSEMBLY AND METHOD OF USE

(75) Inventors: Jerry D. Campbell, Katy, TX (US); Mark C. Duhon, Sugar Land, TX (US); Bennie Gill, Fulshear, TX (US); Geir Melhus, Randaberg (NO); Wayne Nivens, Richmond, TX (US); Kjell M. Randeberg, Randaberg (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 324 days.

(21) Appl. No.: 11/308,441

(22) Filed: Mar. 24, 2006

(65) Prior Publication Data

US 2007/0034381 A1 Feb. 15, 2007

Related U.S. Application Data

(60) Provisional application No. 60/595,878, filed on Aug. 12, 2005.

(51) Int. Cl.

| | |
|---|---|
| ***E21B 17/00*** | (2006.01) |
| ***E21B 17/02*** | (2006.01) |
| ***E21B 17/04*** | (2006.01) |
| ***E21B 17/042*** | (2006.01) |

(52) U.S. Cl. ..... 166/242.6

(58) Field of Classification Search ..... 166/242.6; 403/296, 299, 300, 301, 307, 409.1; 285/87, 285/145.4, 332, 913

See application file for complete search history.

(56) References Cited

U.S. PATENT DOCUMENTS

| | | | | | |
|---|---|---|---|---|---|
| 2,296,198 | A | * | 9/1942 | Boynton | 285/91 |
| 4,554,976 | A | * | 11/1985 | Hynes et al. | 166/341 |
| 4,986,690 | A | | 1/1991 | Cooksey | |
| 5,251,695 | A | * | 10/1993 | Coronado | 166/242.6 |
| 5,341,880 | A | | 8/1994 | Thorstensen | |
| 5,415,441 | A | | 5/1995 | Kilgore | |
| 5,452,923 | A | * | 9/1995 | Smith | 285/123.11 |
| 5,967,691 | A | * | 10/1999 | Lancelot, III | 403/313 |
| 6,059,042 | A | * | 5/2000 | Huber et al. | 166/377 |

(Continued)

FOREIGN PATENT DOCUMENTS

| | | | |
|---|---|---|---|
| GB | 2279119 | A | 12/1994 |

(Continued)

*Primary Examiner*—Jennifer H Gay
*Assistant Examiner*—Cathleen R Hutchins
(74) *Attorney, Agent, or Firm*—Kevin Brayton McGoff; James L. Kurka; Winstead PC

(57) ABSTRACT

A connector assembly for interconnecting wellbore tools to form a tool string include a first adapter having a tool end connectable to a first wellbore tool and an alignment end, a mandrel that has a pin end and an opposing end, the pin end being matable with the alignment end of the first adapter, a second adapter having an adapter end connectable to a second wellbore tool and a second end connected to the opposing end the mandrel and a sleeve that has a first open end and a second open end, the sleeve is moveably disposed over and in connection with the mandrel and the second open end is connectable with the alignment end of the first adapter for interconnecting the first adapter and the second adapter. The connector assembly facilitates hands-free make-up and break-out of tool strings.

18 Claims, 3 Drawing Sheets

U.S. PATENT DOCUMENTS

| | | | | |
|---|---|---|---|---|
| 6,123,152 | A | 9/2000 | Edwards | |
| 6,155,344 | A | 12/2000 | Myers, Jr. | |
| 6,168,213 | B1 | 1/2001 | Muller | |
| 6,257,792 | B1 | 7/2001 | Read, Jr. | |
| 6,397,752 | B1 * | 6/2002 | Yang et al. | 102/275.4 |
| 6,481,498 | B1 * | 11/2002 | Ackroyd et al. | 166/242.6 |
| 6,648,071 | B2 | 11/2003 | Hackworth | |
| 6,658,981 | B2 | 12/2003 | Rochen | |
| 2003/0188867 | A1 * | 10/2003 | Parrott et al. | 166/297 |
| 2005/0022999 | A1 * | 2/2005 | Hughes | 166/380 |
| 2005/0087338 | A1 * | 4/2005 | Parker | 166/242.6 |
| 2005/0155770 | A1 * | 7/2005 | Parrott | 166/380 |
| 2005/0279513 | A1 * | 12/2005 | Eppink | 166/380 |

FOREIGN PATENT DOCUMENTS

| | | | |
|---|---|---|---|
| GB | 2329656 | A | 3/1999 |

* cited by examiner

CONNECTOR ASSEMBLY AND METHOD OF USE

CROSS-REFERENCE TO RELATED APPLICATIONS

This application claims the benefit of U.S. Provisional Patent Application No. 60/595,878 filed Aug. 12, 2005.

BACKGROUND

Field of the Invention

The present invention relates in general to connector assemblies and methods of connecting devices and more particularly to connector assemblies and methods for making-up and breaking-out wellbore tool strings.

After a well has been drilled and casing has been cemented in the well, one or more sections of the casing may be perforated using a string of perforating guns. After the perforating string is lowered into the well to a desired depth, the guns in the string are fired to create openings in the casing and to extend perforations into the surrounding formation. Production fluids in the perforated formation can then flow through the perforations and the casing openings into the wellbore.

In deploying a perforating string in a wellbore, the tools are usually assembled into a relatively long and heavy string, with the string suspended over and run into the wellbore. The perforating string includes a number of perforating guns coupled or fastened together in series, along with other components. The perforating guns are generally aligned in a predetermined pattern as a function of the desired perforation of the well formation.

Present fastening practices typically involve assembling the string manually at the surface before running into the wellbore. Such practices may be subject to human error, inefficiencies, and potential safety hazards. Accordingly, a need exists for a system to couple downhole tools together in series to form a tool string that may be automated and that yields a more reliable connection.

SUMMARY OF THE INVENTION

Accordingly, connector assemblies are provided for making-up and breaking-out wellbore tool strings that facilitate hands-free operations. An embodiment of a connector assembly for interconnecting wellbore tools to form a tool string include a first adapter having a tool end connectable to a first wellbore tool and an alignment end, a mandrel that has a pin end and an opposing end, the pin end being matable with the alignment end of the first adapter, a second adapter having an adapter end connectable to a second wellbore tool and a second end connected to the opposing end the mandrel and a sleeve that has a first open end and a second open end, the sleeve is moveably disposed over and in connection with the mandrel and the second open end is connectable with the alignment end of the first adapter for interconnecting the first adapter and the second adapter.

A embodiment of a method of interconnecting a first wellbore tool and a second wellbore tool to form a wellbore tool string includes the steps of providing a first adapter having a tool end and an alignment end, the alignment end forming a receptacle, connecting the tool end to a first wellbore tool, providing a mandrel having an opposing end connected to a second adapter, a pin end and a sleeve having a first open end engaging the mandrel and a second open end, connecting the second adapter to a second wellbore tool, stabbing the pin end into the receptacle, and interconnecting the wellbore tools by rotating the sleeve in a first direction to axially move the sleeve and thread the second open end of the sleeve onto the alignment end of the first adapter.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
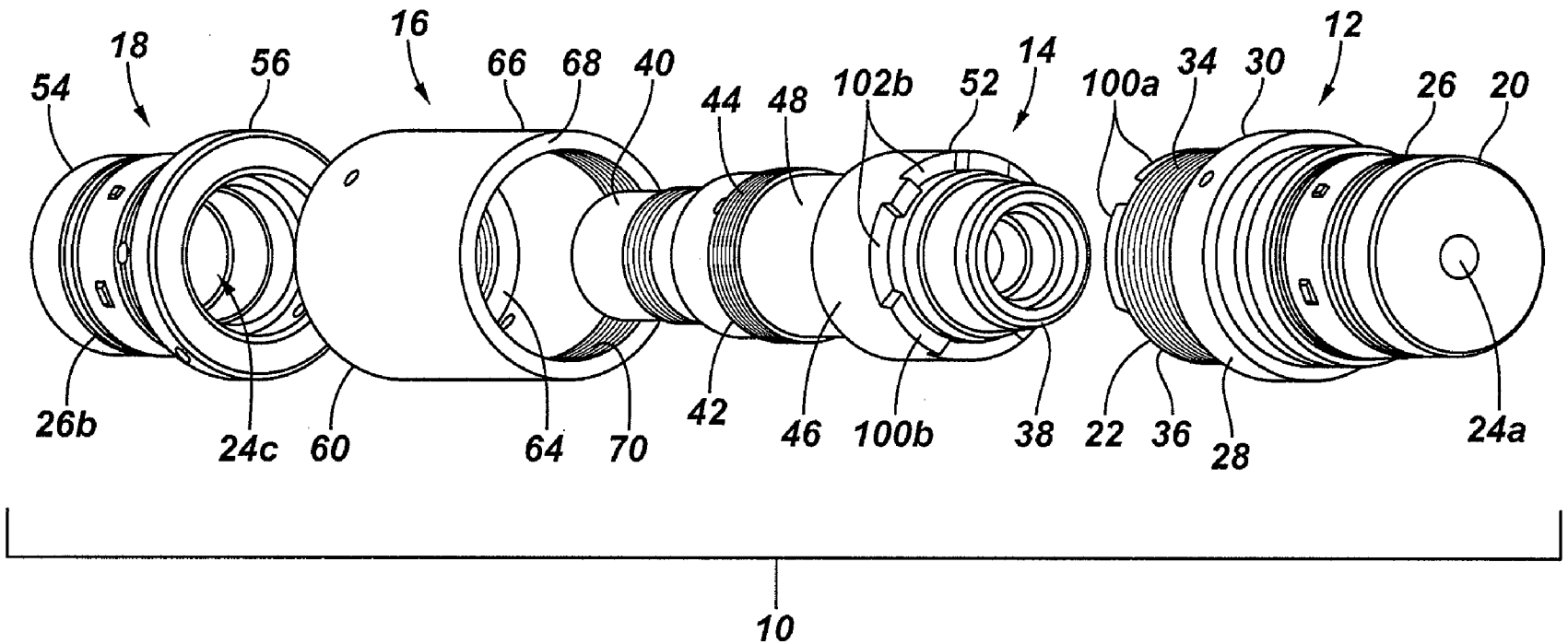
FIG. 1 is an exploded, perspective view of an embodiment of a connector assembly of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

Figure 2:
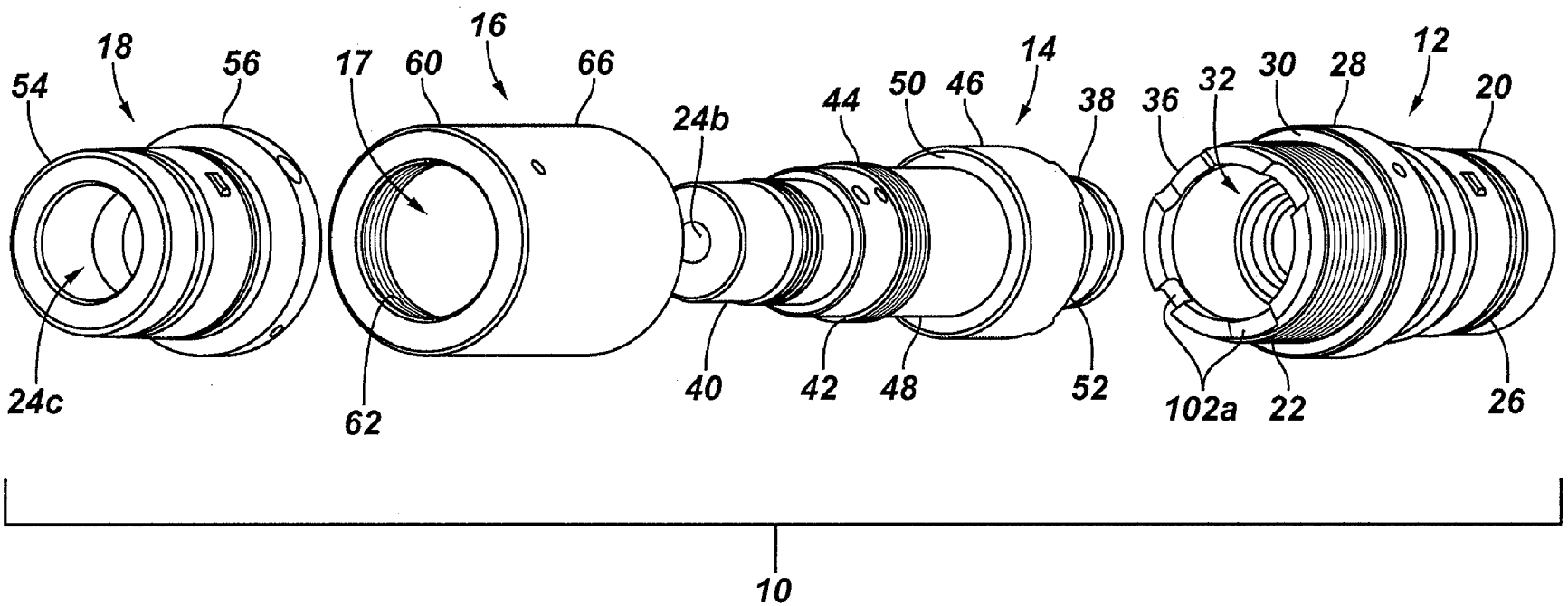
FIG. 2 is an exploded view of the connector assembly of FIG. 1 from another perspective.

FIG. 1 is an exploded, perspective view of an embodiment of a connector assembly of the present invention, generally denoted by the numeral 10. FIG. 2 is an exploded view of connector assembly 10 of FIG. 1 shown from a different perspective. Connector assembly 10 is adapted for interconnecting wellbore tools such as, but not limited to, perforating guns, valves, packers, sand screens, expandable tubing, diverter tools, drilling tools, float equipment, hangers, casing and liner running tools, logging tools, measurement while drilling tools, hydraulic lines, hoses and other well drilling, completion and servicing tools and equipment.

Connector assembly 10 is particularly suited to "hands-free" or "remote" make-up or break-out of wellbore strings, wherein hands-free and remote refer to systems and methods that use automated pipe handling machinery. For example, the present invention may be utilized to make up or break-out a perforating gun string wherein at least two perforating guns are included in the string. Connector assembly 10 facilitates a first wellbore tool held in a rotary table being connected with, or disconnected from, a second perforating gun held in the derrick utilizing a remote operated pipe handling system. Pipe handling systems are well known in the art and thus not illustrated herein. Connector assembly 10 may further include alignment and/or orienting features and elements that facilitate aligning the interconnected wellbore tools so that the tools can be oriented in a desired position in the wellbore.

Figure 4:
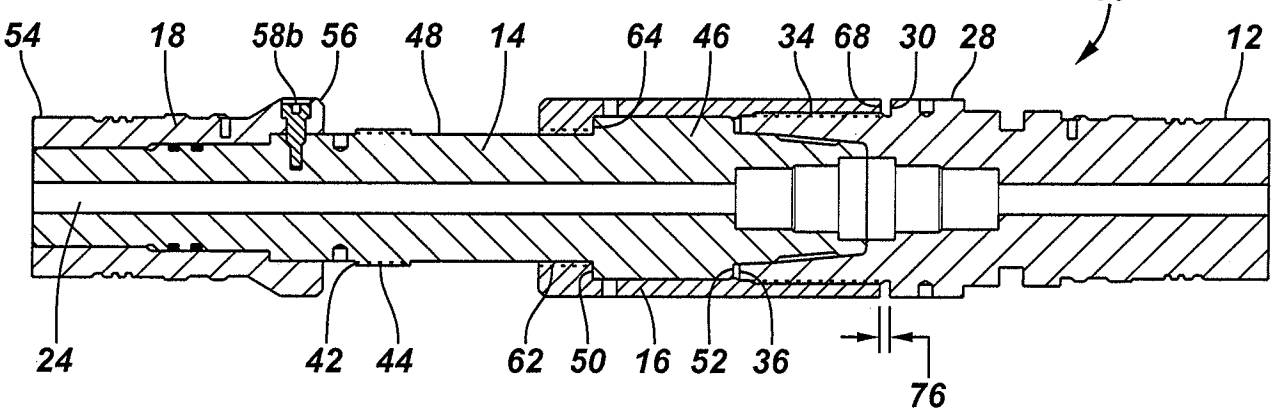
FIG. 4 is a cross-sectional view of an embodiment of the connector assembly in the interconnected configuration.

With reference to FIGS. 1 and 2, connector assembly 10 includes a first tool adapter 12, a coupler mandrel 14, a coupler sleeve 16, and a second tool adapter 18. Connector assembly 10 will commonly form an internal bore 24 extending along its length when in it is in the interconnected configuration as shown in FIG. 4.

Figure 3:
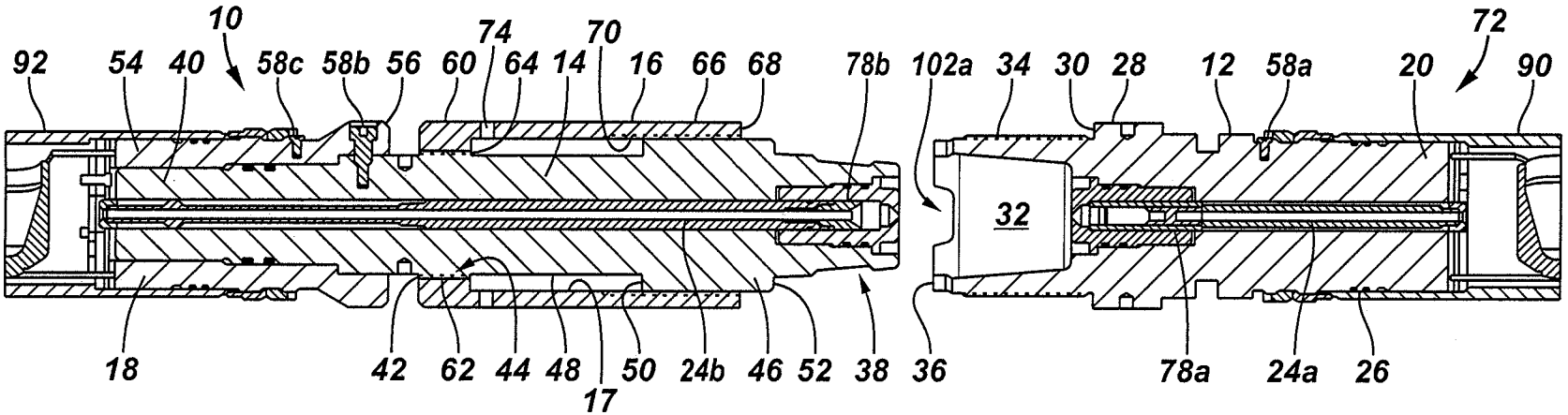
FIG. 3 is a cross-sectional view of an embodiment of a wellbore tool string of the present invention.

First tool adapter 12 includes a tool end 20 and an alignment end 22 interconnected by internal bore section 24*a*. Tool end 20 includes a connection mechanism 26*a* adapted for connecting to a first wellbore tool 90 (FIG. 3). In the illustrated embodiment, connection mechanism 26 is threads, however, it should be realized that tool adapters 12 and 18 may be connected to their respective wellbore tools by various means known in the art including threads, set screws and welding.

First tool adapter 12 includes an upset collar 28 having a collar face 30 oriented toward alignment end 22. Alignment end 22 forms an internal tapered receptacle 32. Alignment end 32 further includes threads 34 formed along its outer surface between collar 28 and outside edge 36. Outside edge 36 may further include alignment features, such as ridges 100*a* and valleys 102*a*.

Coupler mandrel 14 is an elongated member having a tapered pin end 38 and an opposing end 40 interconnected by internal bore section 24*b*. Tapered pin end 38 is adapted for stabbing into tapered receptacle 32 of first tool adapter 12. Opposing end 40 is adapted for connecting with second tool adapter 18.

A raised lip 42 having a outer threaded surface 44 is formed along coupler mandrel 14. Mandrel 14 includes an upset neck 46 spaced from raised lip 42 in the direction of tapered pin end 38. Neck 46 and lip 42 are separated by a run 48. Neck 46 includes a shoulder 50 oriented toward opposing end 40 and an alignment face 52 oriented toward tapered pin end 38. Alignment face 52 includes alignment features 100*b* and 102*b* that are connectable with corresponding alignment features 100*a* and 102*a* of first tool adapter 12.

Second tool adapter 18 has an adapter end 54 and a flange end 56 interconnected by internal bore section 24*c*. Adapter end 54 includes a connecting mechanism 26*b* adapted for connecting with second wellbore tool 92 (FIG. 3). Flange end 56 is adapted for connecting with opposing end 40 of coupler mandrel 14. In the embodiment in FIGS. 3 and 4, flange end 56 is connected to coupler mandrel 14 via a threaded connection and a locking mechanism 58*b*. As described further below, locking mechanism 58*b* facilitates securing coupler mandrel 14 and second tool adapter 18 in a known alignment such that first wellbore tool 90 and second wellbore tool 92 may be disposed in a wellbore (not shown) in a desired orientation.

It should further recognized that end 56 is described as "flange end" for purposes of differentiation from other element ends and does not necessarily have to be configured as a flange. Flange end 56 in the illustrated embodiment does include a flange configuration that limits the axial travel of coupler sleeve 16, however other design configurations may be utilized.

Coupler sleeve 16 is a cylindrical member having a reduced diameter end 60 and a full diameter end 66 defining an internal bore 17. Reduced diameter end 60 has internal threads 62 that correspond with threads 44 of raised lip 42. Reduced diameter end 60 includes an internal ledge 64 adapted to contact shoulder 50 of coupler mandrel 14 and limit the axial travel of sleeve 16 in one direction.

Full diameter end 66 of sleeve 16 has an outer face 68. At least a portion of bore 17 proximate full diameter end 66 is threaded 70. Threads 70 are compatible with threads 34 of first tool adapter 12.

Coupler sleeve 16 is disposed over mandrel 14 with reduced diameter end 60 oriented toward flange end 56 of second tool adapter 18 and sleeve face 68 oriented toward upset neck 46. Axial movement of coupler sleeve 16 is limited between flange end 56 and shoulder 50 of upset neck 46.

FIG. 3 is a cross-sectional view of a wellbore tool string 72, utilizing an embodiment of connector assembly 10, prior to being made-up. In this embodiment, tool string 72 is a perforating gun string and both first and second wellbore tools 90, 92 are perforating guns. For reference, first perforating gun 90 is a lower tool and second perforating gun 92 is the next tool in string 72, wherein the lower tool is run into the wellbore first.

First perforating gun 90 is threadedly connected to tool end 20 of first tool adapter 12. First tool adapter 12 may be further secured to perforating gun 90 in set position so that the orientation of gun 90 is known relative to outside edge 36 and alignment features 100*a* and 102*a* by a locking mechanism 58*a* such as, but not limited to, a set screw.

Coupler sleeve 16 is disposed over coupler mandrel 14 with reduced diameter end 60 oriented toward opposing end 40 of mandrel 14 and full diameter end 66 extending toward taper pin end 38 of mandrel 14. Reduced diameter end 60 is threadedly connected to raised lip 42, securing coupler sleeve 16 in the disconnected position. Coupler sleeve 16 may further include a port 74 to equalize the pressure between sleeve 16 and run 48 and the exterior of sleeve 16.

Opposing end 40 is connected within second tool adapter 18 which is connected to second perforating gun 92. It may be desired to secure mandrel 14, in particular alignment face 52 and alignment features 100*b* and 102*b*, in a known orientation with perforating gun 92. Locking mechanism 58*b* between second tool adapter 18 and mandrel 14 and/or locking mechanism 58*c* between wellbore tool 92 and tool adapter 18 may be utilized to secure mandrel 14 in the aligned position.

FIG. 4 is a cross-sectional view of connector assembly 10 interconnected. With reference to FIGS. 1 through 4 a method of interconnecting wellbore tools 90 and 92 to form a wellbore string 72 is described. First wellbore tool 90 is positioned and held by the rotary table of a rig and second wellbore tool 92 is held in the derrick.

Tapered pin end 38 is stabbed into tapered receptacle 32. Coupler sleeve 16 is rotated in a first direction relative to mandrel 14 via power tongs or other rotation means. When rotated in the first direction, sleeve 16 moves axially along mandrel 14 toward first tool adapter 12 and full diameter end 66 threadedly connects with first tool adapter 12. Sleeve 64 will continue to move axially until internal ledge 64 contacts neck shoulder 50. Further rotation of sleeve 16 in the first direction will result in rotational movement of mandrel 14 until alignment features 100*b* and 102*b* mate with alignment features 100*a* and 102*a*. To ensure that connector assembly 10 is properly made-up, a gap 76 (FIG. 4) of a selected distance between collar face 30 of first tool adapter 12 and sleeve face 68 that can be seen by an operator on the rig floor may be provided. For example, a gap 76 of approximately one-quarter inch may be provided to readily identify when connector assembly 10 is properly made-up and tools 90 and 92 are aligned in a desired orientation. Once string 72 is made up it can be run into the wellbore.

Connector assembly 10 includes a sealed ballistic transfer type sealing element 78*a* positioned at bore section 24*a* of first tool adapter 12. A second sealed ballistic transfer type sealing element 78*b* is positioned at bore section 24*b* of coupler mandrel 14. The use of sealed ballistic transfer type sealing elements 78*a* and 78*b* eliminates the use of O-ring type sealing elements thus eliminate the need for personnel on the rig floor to manually check for proper O-ring installation prior to connecting the well tools 90 and 92. Thus, sealed ballistic transfer elements 78*a* and 78*b* further facilitate the hands-free operation of connector assembly 10.

To break-out a wellbore tool string 72, string 72 is pulled out of the hole, second wellbore tool 72 is positioned in the derrick and first wellbore tool 90 is held in the rotary table. Sleeve 16 is rotated in a second direction relative to mandrel 14, disconnecting full diameter end 66 from alignment end 22 of tool adapter 12. As sleeve 16 is rotated in the second direction it moves axially toward second tool adapter 18 and reduced diameter end 60 threads onto raised lip 42 securing sleeve 16 in the disconnected position.

From the foregoing detailed description of specific embodiments of the invention, it should be apparent that a system for interconnecting wellbore tools utilizing hands-free devices that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A hands-free connector assembly for interconnecting wellbore tools to form a tool string, the connector assembly comprising:

a first adapter having a tool end connectable to a first wellbore tool and an alignment end;

a mandrel having a pin end and an opposing end, the pin end matable with the alignment end of the first adapter, wherein the mandrel provides an upset neck;

a second adapter having an adapter end connectable to a second wellbore tool and a second end connected to the opposing end the mandrel; and a sleeve having a first open end and a second open end, the sleeve moveably disposed over and in connection with the mandrel, the first open end threadably connected to the mandrel and the second open end being threadably connectable with the alignment end of the first adapter for interconnecting the first adapter and the second adapter, wherein the upset neck of the mandrel has a diameter greater than a diameter of the first open end and less than a diameter of the second open end.

2. The connector assembly of claim 1, wherein the first open end of the sleeve has a reduced diameter relative to the second open end of the sleeve.

3. The connector assembly of claim 2, wherein the first adapter further includes an upset collar having a face oriented toward the alignment end, the face positioned such that when the second open end is fully connected to the alignment end of the first adapter a gap is formed between a face of the second open end and the face of the collar.

4. The connector assembly of claim 2, further including means for aligning the first adapter and the second adapter in a desired orientation when interconnected.

5. The connector assembly of claim 1, wherein the first open end is disposed about the mandrel between the upset neck and the second adapter.

6. The connector assembly of claim 5, wherein the mandrel further includes a lip positioned between the upset neck and the second adapter, the first open end being threadedly connected to an outer surface of the lip.

7. The connector assembly of claim 5, wherein the first adapter further includes an upset collar having a face oriented toward the alignment end, the face positioned such that when the second open end is fully connected to the alignment end of the first adapter a gap is formed between a face of the second open end and the face of the collar.

8. The connector assembly of claim 1, wherein the first adapter further includes an upset collar having a face oriented toward the alignment end, the face positioned such that when the second open end is fully connected to the alignment end of the first adapter a gap is formed between a face of the second open end and the face of the collar.

9. The connector assembly of claim 8, further including means for aligning the first adapter and the second adapter in a desired orientation when interconnected.

10. The connector assembly of claim 1, further including means for aligning the first adapter and the second adapter in a desired orientation when interconnected.

11. A hands-free connector assembly for interconnecting wellbore tools to form a tool string, the connector assembly comprising:

a first adapter having a tool end connected to a first wellbore tool, an alignment end having external threads and an internal tapered receptacle, and an upset collar having a face directed toward the alignment end;

first alignment features positioned on an outside edge of the alignment end;

a second adapter having an adapter end connected to a second wellbore tool;

a mandrel having an opposing end connected to the second adapter, a tapered pin end matable with the tapered receptacle, a lip having a threaded outer surface, and an upset neck having an alignment face oriented toward the pin end;

second alignment features positioned on the alignment face matable with the first alignment features to orient the first and the second wellbore tools; and a sleeve having a first open end positioned between the upset neck and the second adapter, the first open end having internal threads matable with the threads on the lip and a diameter less than the diameter of the upset neck, and a second open end having internal threads matable with the threads on the alignment end and having a diameter greater than the diameter of the upset neck;

wherein when the connector assembly is disconnected the first open end is threaded onto the lip and the second open end is disconnected from the alignment end, and when the connector assembly is in the interconnected position and the first wellbore tool and the second wellbore tool are aligned the second open end is threaded onto the alignment end and a defined gap is formed between the collar face and a face of the second open end of the sleeve.

12. The connector assembly of claim 11, wherein the first wellbore tool is a perforating gun and the second wellbore tool is a perforating gun.

13. A hands-free connector assembly for interconnecting wellbore tools to form a tool string, the connector assembly comprising:

a first adapter having a tool end connectable to a first wellbore tool and an alignment end, wherein the first adapter further includes an upset collar having a face oriented toward the alignment end;

a mandrel having a pin end and an opposing end, the pin end matable with the alignment end of the first adapter;

a second adapter having an adapter end connectable to a second wellbore tool and a second end connected to the opposing end the mandrel; and a sleeve having a first open end and a second open end, the sleeve moveably disposed over and in connection with the mandrel, the first open end threadably connected to the mandrel and the second open end being threadably connectable with the alignment end of the first adapter for interconnecting the first adapter and the second adapter, the face positioned such that when the second open end is fully connected to the alignment end of the first adapter a gap is formed between a face of the second open end and the face of the collar.

14. The connector assembly of claim 13, wherein the first open end of the sleeve has a reduced diameter relative to the second open end of the sleeve.

15. The connector assembly of claim 14, further including means for aligning the first adapter and the second adapter in a desired orientation when interconnected.

16. The connector assembly of claim 13, wherein the mandrel further includes an upset neck having a diameter greater than the diameter of the first open end and less than the diameter of the second open end, wherein the first open end is disposed about the mandrel between the upset neck and the second adapter.

17. The connector assembly of claim 16, wherein the mandrel further includes a lip positioned between the upset neck and the second adapter, the first open end being threadedly connected to an outer surface of the lip.

18. The connector assembly of claim 13, further including means for aligning the first adapter and the second adapter in a desired orientation when interconnected.

* * * * *